US011293203B2

(12) United States Patent
Rak

(10) Patent No.: US 11,293,203 B2
(45) Date of Patent: Apr. 5, 2022

(54) HANDCUFFS ASSIST DEVICE

(71) Applicant: Stanley C. Rak, Whitehouse Station, NJ (US)

(72) Inventor: Stanley C. Rak, Whitehouse Station, NJ (US)

( * ) Notice: Subject to any disclaimer, the term of this patent is extended or adjusted under 35 U.S.C. 154(b) by 283 days.

(21) Appl. No.: 16/368,027

(22) Filed: Mar. 28, 2019

(65) Prior Publication Data

US 2020/0308879 A1 Oct. 1, 2020

(51) Int. Cl.
*E05B 75/00* (2006.01)

(52) U.S. Cl.
CPC ..... *E05B 75/00* (2013.01)

(58) Field of Classification Search
CPC ..... E05B 75/00; Y10T 70/404
USPC ..... 70/15–18
See application file for complete search history.

(56) References Cited

U.S. PATENT DOCUMENTS 3,392,554 A 7/1968 Williamson
4,024,736 A * 5/1977 De Michieli ..... E05B 75/00 70/16
4,162,622 A 7/1979 Daleo
5,205,142 A 4/1993 Kruger et al.
2005/0193782 A1* 9/2005 Beane ..... E05B 75/00 70/16
2006/0272366 A1* 12/2006 Kim ..... E05B 75/00 70/16
2010/0031709 A1* 2/2010 Kim ..... E05B 75/00 70/16
2012/0085135 A1 4/2012 Louden
2013/0333425 A1 12/2013 Krelle
2015/0013690 A1 1/2015 Dufek
2020/0131807 A1 4/2020 Heiney

OTHER PUBLICATIONS

Jun. 19, 2020 International Search Report and Written Opinion in PCT/US2020/24475 filed Mar. 24, 2020.

* cited by examiner

*Primary Examiner* — Suzanne L Barrett
(74) *Attorney, Agent, or Firm* — Mintz Levin Cohn Ferris Glovsky and Popeo, P.C.

(57) ABSTRACT

A handcuffs assist device. The device includes a housing including a shaft. The housing includes one or more pulley wheels positioned about the shaft and coupled to a first end of one or more handcuff cables. A second end of the handcuff cables is coupled to one or more handcuffs. The housing includes a ratcheting mechanism having a sprocket wheel positioned about the shaft and a locking bar coupled to the housing. The locking bar has a locked configuration and an unlocked configuration. At least one of the shaft, the one or more pulley wheels and the sprocket wheel is configured to rotate about the shaft in a first direction and not in the second direction when the ratcheting mechanism is in a locked configuration.

20 Claims, 6 Drawing Sheets

HANDCUFFS ASSIST DEVICE

TECHNICAL FIELD

In some implementations, the current subject matter generally relates to law enforcement, and in particular, to a handcuffs assist device and corresponding method of use.

BACKGROUND

Typically, crime is an unlawful act that is punishable by a state or other authority. Crime involves offenses against a person (e.g., assault, battery, murder, etc.), property (e.g., theft, robbery, etc.), state (e.g., treason, espionage, etc.), etc. Federal, state, and/or local governments use law enforcement personnel, e.g., police departments, federal and state law enforcement agencies (e.g., Federal Bureau of Investigation (FBI)), etc., to protect lives, liberty and possessions of citizens, as well as to prevent crime and civil disorder. Law enforcement personnel have powers of arrest and legitimized use of force.

To properly perform their policing functions, law enforcement personnel requires use of various gear, weapons, as well as methods. The gear typically includes radio equipment, bulletproof vests, nightsticks, as well as the most commonly used gear—handcuffs, ankle bracelets, etc. (hereinafter, "handcuffs"). Handcuffs provide law enforcement personnel with an ability to restrain an individual, when, for example, placing them under arrest. Handcuffs are lockable devices that are placed around individual's wrists (either while the individual's hands are in front or in the back of them) while the wrists are in close proximity to each other. This restrains the individual's ability to perform various acts, including potentially harming the arresting law enforcement personnel. However, conventional handcuffs may sometimes be difficult to place on an individual, especially when that individual is resisting arrest and hence, there is a need for an improved handcuff assisting device.

SUMMARY

In some implementations, the current subject matter relates to a handcuffs assist device (as for example described above). The device may include a housing including a shaft. The housing may also include one or more pulley wheels positioned about the shaft and coupled to a first end of one or more handcuff cables, wherein a second end of the one or more handcuff cables being coupled to one or more handcuffs. Further, the housing may also include a ratcheting mechanism including a sprocket wheel positioned about the shaft and a locking bar coupled to the housing, the locking bar having a locked configuration and an unlocked configuration. At least one of the shaft, the one or more pulley wheels and the sprocket wheel may be configured to rotate about the shaft in a first direction and not in the second direction when the ratcheting mechanism is in a locked configuration.

In some implementations, the current subject matter may include one or more of the following optional features. In some implementations, rotation of the one or more pulley wheels in the first direction may be configured to wind the one or more handcuff cables about the one or more pulley wheels, thereby positioning the handcuffs proximate to one another. In some implementations, the sprocket wheel may include a plurality of sprocket wheel teeth. The locking bar may include a plurality locking bar teeth. The sprocket wheel teeth and the locking bar teeth may be configured to engage each other when the ratcheting mechanism is in the locked configuration, thereby preventing rotation of the sprocket wheel in a second direction. The second direction may be opposite the first direction.

In some implementations, the device may include a locking mechanism configured to engage and disengage the locked configuration of the ratcheting mechanism.

In some implementations, the device may include a coil spring positioned about the shaft, wherein the coil spring is configured to increase speed of rotation of at least one of the shaft, the one or more pulley wheels and the sprocket wheel about the shaft in the first direction, thereby tensioning the one or more cables. A first end of the coil spring may be coupled to the shaft and a second end of the coil spring may be coupled to the housing. The shaft may be rotatably coupled to at least one portion all of the housing. At least one of the one or more pulley wheels, the sprocket wheel, and at least one end of the coil spring may be permanently coupled to the shaft.

In some implementations, the shaft may be permanently coupled to at least one portion all of the housing. At least one of the one or more pulley wheels, the sprocket wheel, and at least one end of the coil spring may be rotatably coupled to the shaft.

In some implementations, the locking bar may be coupled at another portion of the housing.

In some implementations, the housing may be a housing of the one or more handcuffs.

In some implementations, the handcuff assist device may be separate from the one or more handcuffs and may be configured to be coupled to each of the one or more handcuffs using the one or more cables.

In some implementations, the current subject matter relates to a handcuff. The handcuff may include a housing that, in turn may include a wrist cuffing portion, and a handcuff assist device. The handcuff assist device may include a shaft, one or more pulley wheels positioned about the shaft and coupled to a first end of one or more handcuff cables, wherein a second end of the one or more handcuff cables being coupled to another handcuff, a ratcheting mechanism including a sprocket wheel positioned about the shaft and a locking bar coupled to the housing, the locking bar having a locked configuration and an unlocked configuration. At least one of the shaft, the one or more pulley wheels and the sprocket wheel may be configured to rotate about the shaft in a first direction and not in the second direction when the ratcheting mechanism is in a locked configuration.

In some implementations, the current subject matter may include one or more of the following optional features. In some implementations, rotation of the one or more pulley wheels in the first direction may be configured to wind the one or more handcuff cables about the one or more pulley wheels, thereby positioning the another handcuff proximate to the handcuff.

In some implementations, the sprocket wheel mat include a plurality of sprocket wheel teeth. The locking bar may include a plurality locking bar teeth. The sprocket wheel teeth and the locking bar teeth may be configured to engage each other when the ratcheting mechanism is in the locked configuration, thereby preventing rotation of the sprocket wheel in a second direction. The second direction may be opposite the first direction.

In some implementations, the handcuff may include a locking mechanism configured to engage and disengage the locked configuration of the ratcheting mechanism.

In some implementations, the handcuff may include a coil spring positioned about the shaft, wherein the coil spring is configured to increase speed of rotation of at least one of the shaft, the one or more pulley wheels and the sprocket wheel about the shaft in the first direction, thereby tensioning the one or more cables. A first end of the coil spring may be coupled to the shaft and a second end of the coil spring may be coupled to the housing.

In some implementations, the shaft may be rotatably coupled to at least one portion all of the housing, and at least one of the one or more pulley wheels, the sprocket wheel, and at least one end of the coil spring may be permanently coupled to the shaft.

In some implementations, the shaft may be permanently coupled to at least one portion all of the housing, and at least one of the one or more pulley wheels, the sprocket wheel, and at least one end of the coil spring may be rotatably coupled to the shaft.

In some implementations, the locking bar may be coupled at another portion of the housing.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

Some embodiments of the current subject matter relate to a handcuffs assist device and method. The device may provide assistance to law enforcement personnel in restraining an individual placed under arrest.

Conventional handcuffs (or, alternatively, ankle cuffs) are restraint devices that are typically designed to secure wrists (or alternatively, ankles) of an individual in close proximity to one another. In the following description, handcuffs and ankle cuffs or any other type of restraining device that restricts movement of limbs of an individual will be referred to as handcuffs. The handcuffs usually include two parts (one for each wrist) that are linked together by a chain, a hinge, or a rigid bar. Handcuffs may be placed on the person's wrists (each part (typically, having a circular shape) has a rotating arm which engages with a ratchet that prevents it from being opened once closed around a person's wrist. A key may be used to open the handcuffs. Without an appropriate key, handcuffs cannot be removed. Moreover, a handcuffed individual is unable to move his/her wrists more than a few inches or centimeters apart, thereby making movements or other tasks difficult/impossible to perform and hence, restraining the individual. Handcuffs are typically used to prevent suspected criminals from escaping from law enforcement personnel.

There are many variations of the handcuffs, some of which may be manufactured from metal, plastic, and/or any other material. Conventional metal handcuffs may be linked by a chain (e.g., a short chain), a hinge (e.g., hinged handcuffs further restrict movement of an individual and hence, may be more secure), and rigid solid bar handcuffs (which are even more secure). Non-metal handcuffs include plastic restraints, wrist ties, riot cuffs, plasticuffs, flexicuffs, flex-cuffs, tri-fold cuffs, zap straps, zip cuffs, or zip-strips that are lightweight, disposable plastic strips, which are similar to electrical cable ties.

Figure 1A:
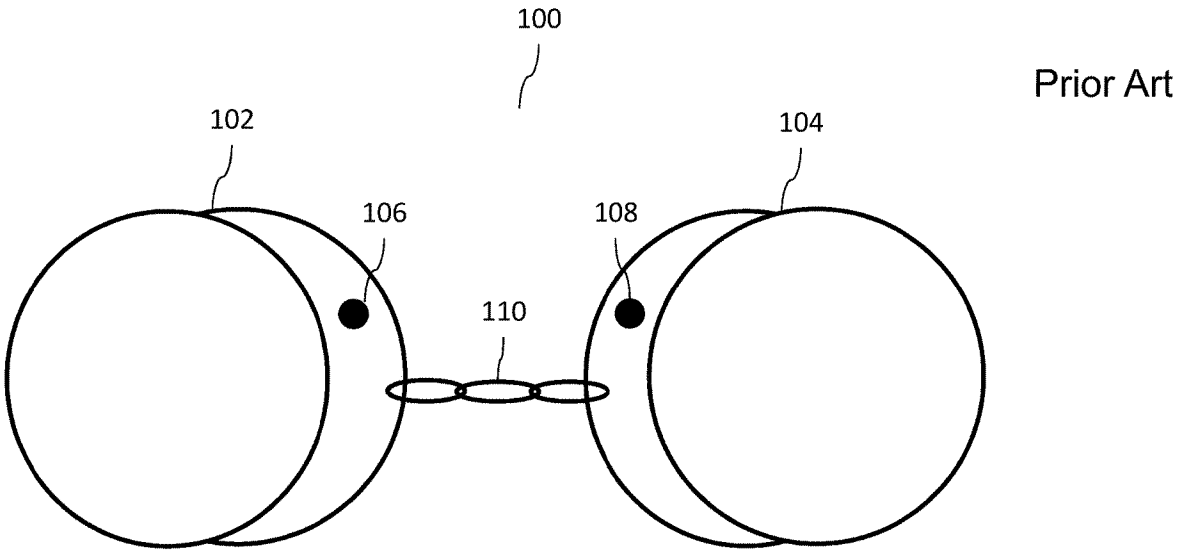
FIGS. 1*a* and *b* illustrate conventional restraining device or handcuffs.
Figure 1B:
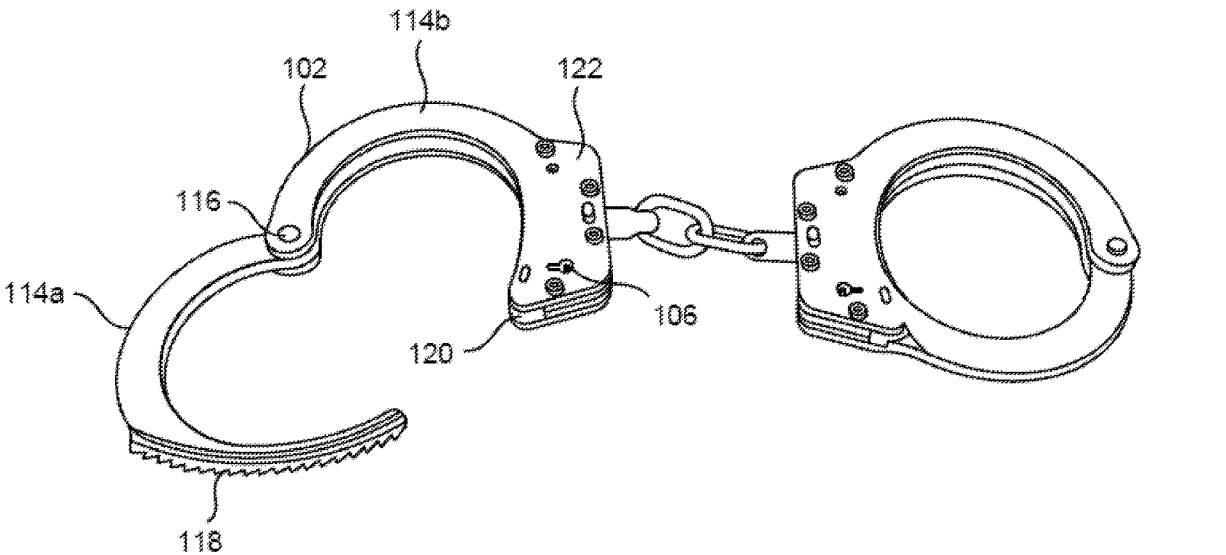

FIGS. 1*a* and *b* illustrate conventional restraining device or handcuffs 100. The handcuffs 100 include a first part 102 and a second part 104 that are linked by a chain 110. The part 102 includes a locking keyhole 106 and the part 104 includes a locking keyhole 108. The keyholes 106, 108 are used for unlocking the handcuffs 100, as shown in FIG. 1*b*. The parts 102, 104 are typically substantially circular when locked and have an open interior portion that is surrounded by a rigid outer band 112. The band 112 includes two portions 114*a* and 114*b* that are hingedly connected to each other using hinge 116. Hinge 116 allows rotational movement of the portions 114 during locking (cuffing) or unlocking (uncuffing) of the handcuffs.

The portion 114*a* includes a plurality of ratchet teeth 118 that interact with a locking stopper (not shown in FIGS. 1*a-b*) stowed inside the locking portion 122. During locking, the portion 114*a* is inserted into an opening 120 of the locking portion 122 being part of the portion 114*b*, where the opening 120 is appropriately sized to allow insertion of the portion 114*a*. Upon insertion of the portion 114*a*, the teeth 118 begin to engage the stopper inside the locking portion 120. The stopper prevents removal of the portion 114*a* from the opening 120. To unlock the portion 114*a* from the portion 114*b*, a key (not shown in FIGS. 1*a-b*) is inserted into the keyhole 106 of the part 102 (similarly for part 104), is turned and pushes the stopper away from the teeth 118, thereby allowing smooth removal of the portion 114*a* from the opening 120, thereby freeing the locked wrists of the individual.

To use the handcuffs 100, the parts 102, 104 are unlocked and opened, as shown in FIG. 1*b*, and individual's wrists are positioned between parts 114*a* and 114*b* of each part 102, 104. One or both parts 114*a* and 114*b* are rotated around hinge 116 toward each other and are pushed until the individual's wrists cannot be easily removed, thereby restraining the individual. Unlocking the wrists requires insertion of a key into each keyhole 106, 108, and opening of the handcuffs, as described above.

However, conventional handcuffs may sometimes be difficult to put on an individual, especially, if the individual is resisting (e.g., resisting arrest) being handcuffed. In this situation, additional law enforcement personnel may be required to adequately subdue the individual so that individuals wrists are in close proximity to each other allowing handcuffs to be properly administered. Further, in especially difficult situations, injuries to law enforcement personnel may occur with violently resisting individuals.

The current subject matter provides a handcuff assist device that enables law enforcement personnel to more easily restrain an individual with handcuffs. The current subject matter's assist device does not require that individual's wrists are brought in close proximity to each other for administration. In fact, the individual's wrists may be cuffed at any distance (e.g., arm's length of the individual or both arm's lengths). To use the assist device, a law enforcement personnel may place one of the handcuffs on one of the individual's wrists and then place the other handcuff on the other wrist without having to put the wrists of the individual in close proximity to one another.

The handcuff assist device may include one or more cables that may be configured to connect one handcuff to the other and a spring loaded mechanism located one or both handcuffs and coupled to one or both cables. The cables may be stowed (or wound up) inside the housing of one or both cuffs and, when the handcuffs are ready for use (either when one or both of the handcuffs is already placed on individual's wrist(s) or prior to placing the handcuffs on the wrist(s)), one or both cables may be pulled out of the housing of the handcuffs, thereby tensioning the spring loaded mechanism. The spring loaded mechanism may be configured to pull the cables into the housing of the handcuffs. It may also include a ratchet mechanism, having a plurality of ratchet teeth or any other stopping mechanism, that may prevent the spring loaded mechanism from accidentally unwinding the cables and hence, lengthening the cables and, in turn, the distance between individual's wrists once that individual is handcuffed.

As stated above, once both handcuffs are placed on the individual's wrists, the cables together with the spring loaded mechanism, due to the tensioned spring, may begin pulling the individual's wrists toward each other, while at the same time preventing unwinding of the cables, thereby shortening the distance between the wrists and hence, more easily restraining the individual. The handcuff assist device may work either in the front of the individual or behind the individual's back. The handcuff assist device may work as an ankle cuffing device in a similar fashion.

The handcuffs may also include a release button or a keyhole that may allow unlocking of the ratchet teeth or any other stopping mechanism, and hence, releasing of the spring loaded mechanism and causing the cable(s) to be easily pulled out of the housing of the handcuffs. The handcuffs may also include another keyhole that may allow removal of handcuffs by uncuffing of each handcuff from the wrists. Alternatively, the keyhole for releasing of the spring loaded mechanism may be used to uncuff the handcuffs from the individual's wrists. For example, once the key is inserted into the keyhole, rotation of the key in one direction (e.g., clockwise) will release the spring loaded mechanism/cables and rotation of the key in an opposite direction (e.g., counter-clockwise) will allow removal of handcuffs from the individual's wrists. In some implementations, a release/lock button in addition to the key may be used to release and/or lock the cabling.

Figure 2:
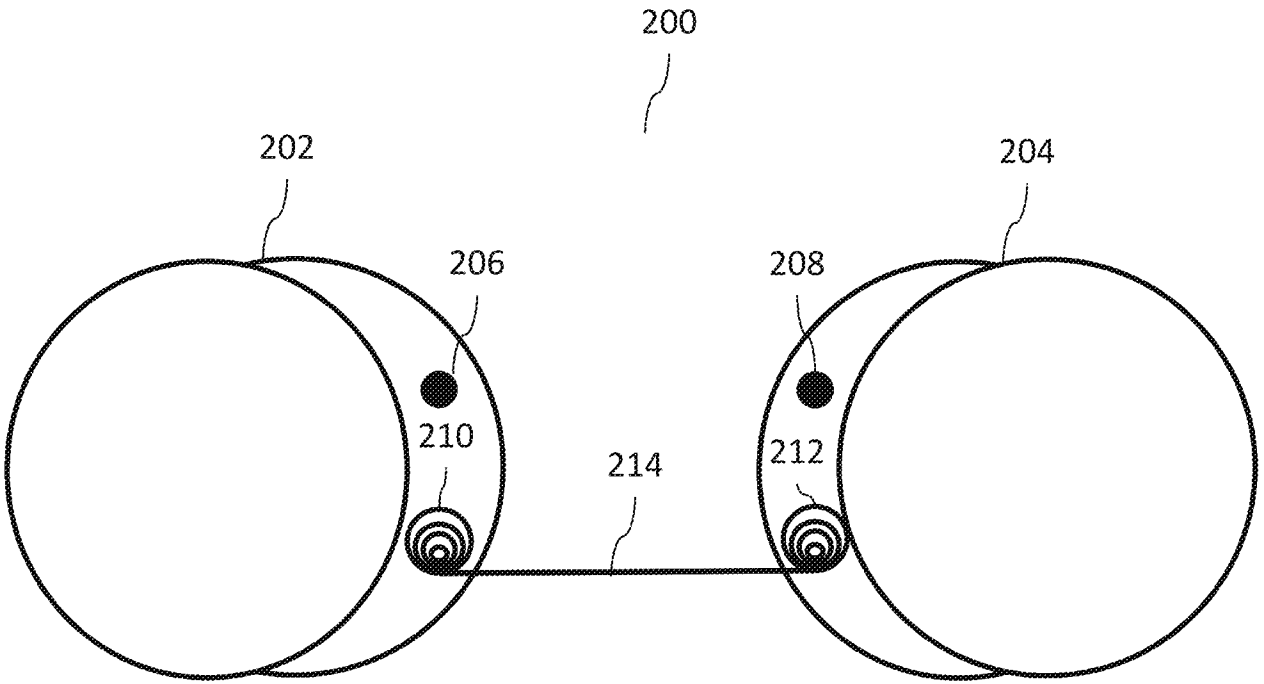
FIG. 2 illustrates an exemplary handcuff assist device or system, according to some implementations of the current subject matter.

FIG. 2 illustrates an exemplary handcuff assist device or system 200, according to some implementations of the current subject matter. The handcuff assist device 200 may include a pair of handcuffs 202 and 204. In some implementations, the handcuffs 202 and 204 may lock and unlock around individual's wrists in a similar fashion to the handcuffs 100 shown in FIGS. 1*a-b*. Once locked, the handcuffs 202, 204 may be unlocked using a key that may be inserted into keyholes 206, 208, respectively.

In some implementations, one or both handcuffs 202, 204 may also include cable tensioning and connection mechanism 210, 212, respectively. The mechanisms 210, 212 may be configured to be connected by a cable 214. In some implementations, one of the handcuffs 202, 204 may include cable tensioning and connection mechanism that may allow extension and/or retraction of the cable 214 from and/or into, respectively, in the handcuffs 202, 204, while other handcuff is permanently (e.g., welded, glued, soldered, etc.) connected (and/or detachably connected using a male-female connection, a hook, a snap, a ball, a chain, etc. and/or any combination thereof) to the cable 214. For example, handcuff 202 may include the cable and tensioning mechanism 210 that may allow extension/retraction of cable 214 and the handcuff 204 may be permanently connected to the cable 214 at connection 212. In alternate implementations, both handcuffs may include separate cable tensioning and connection mechanisms 210, 212 (as for example is shown in FIG. 2). Moreover, more than one cable 214 may be used to connect handcuffs 202, 204.

In some implementations, the cable tensioning and connection mechanism may be disposed inside a housing of each handcuff. Alternatively, the cable tensioning and connection mechanism may be separate from the handcuffs, where a separate cable may be configured to be individually connected to each handcuff.

Figure 3:
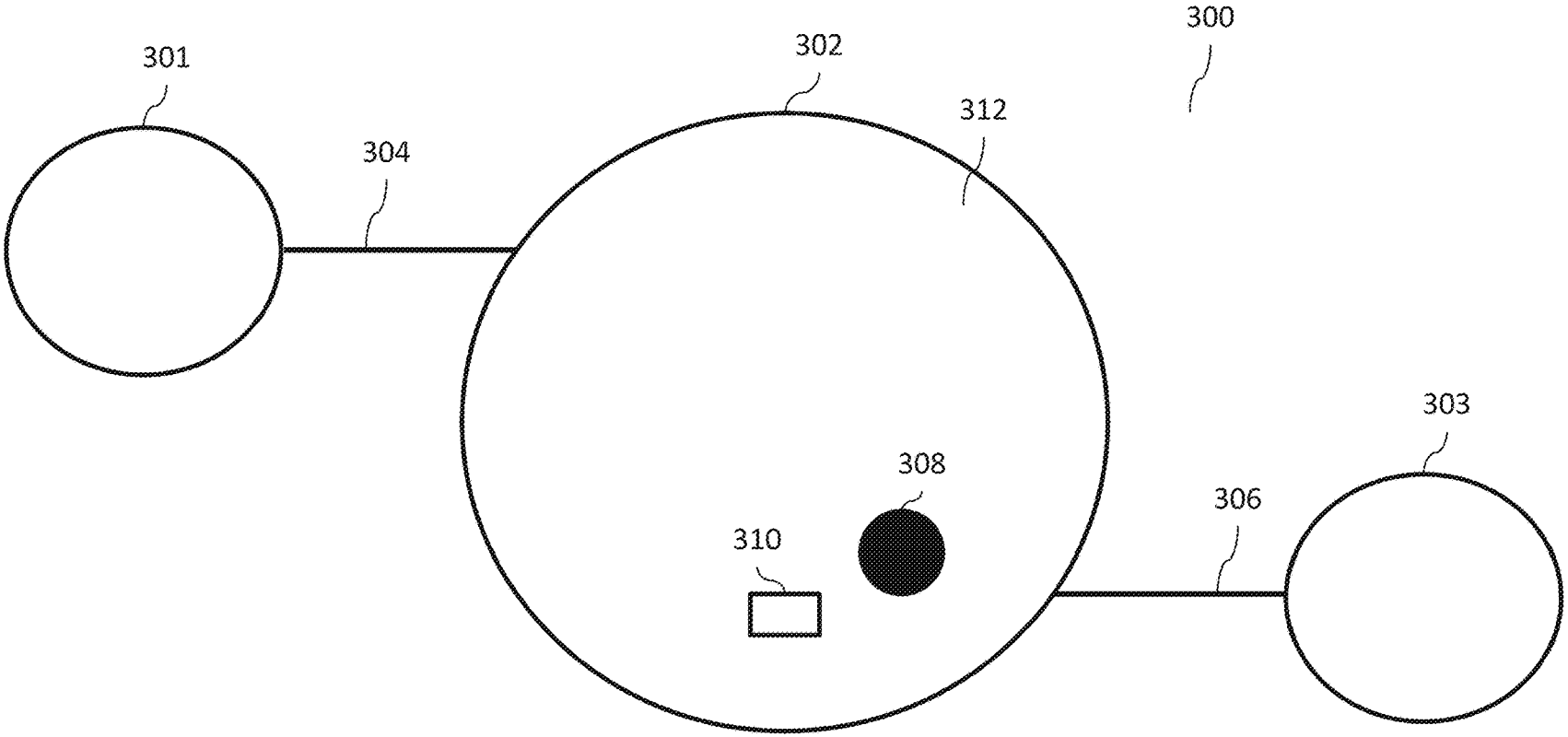
FIG. 3 illustrates an exemplary handcuff assist device or system, according to some implementations of the current subject matter.

FIG. 3 illustrates an exemplary handcuff assist system 300, according to some implementations of the current subject matter. The system 300 include a first handcuff 301, a handcuff assist device 302, and a second handcuff 303. The first handcuff 301 is connected to the handcuff assist device 302 using a cable 304 and the second handcuff 303 is connected to the handcuff assist device using a cable 306. The handcuff assist device 302 may include a lock button 308 and a keyhole 310. The lock button 308 and the keyhole 310 may be used to lock and/or release one or both cables 304, 306. The tensioning and connection mechanism may be disposed inside a housing 312 of the handcuff assist device 302.

The handcuff assist device 302 may have any shape (e.g., oval, circular, square, rectangular, irregular, etc.) and may be manufactured from any desired material (e.g., metal, steel, plastic, carbon fiber, wood, etc.). The handcuff assist device 302 may have any desired size (it is noted that FIG. 3 is not drawn to scale). The cables 304, 306 may also be manufactured from any desired material (e.g., metal, steel, plastic, carbon fiber, fabric, etc.). Further, cables 304, 306 may have any desired length, thickness, rigidity, flexibility, etc. However, the cables' lengths may be limited by an ability of an interior space of the housing 312 to fit these cables in a wound state (where the cables maybe wound around their own rotatable pulleys or wheels). If the cable assist device 302 is disposed inside one or both handcuffs, then the housing 312 is the housing of the handcuff.

Figure 4:
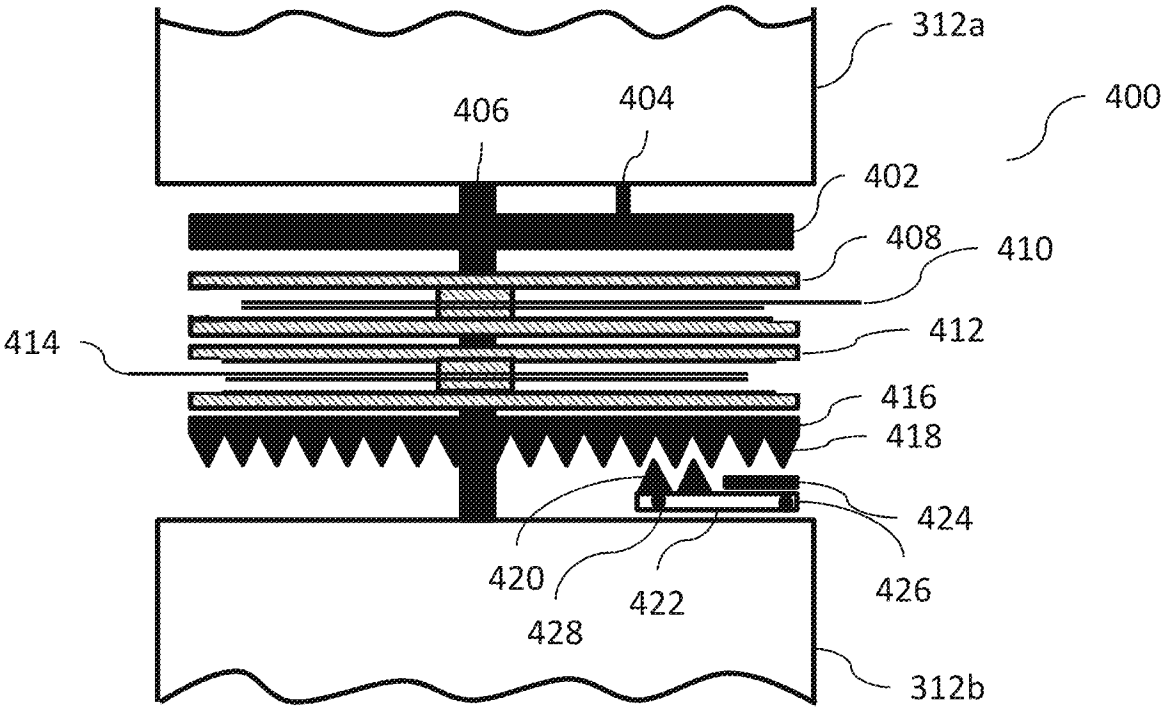
FIG. 4 illustrates details of the exemplary handcuff assist device, according to some implementations of the current subject matter.

FIG. 4 illustrates details of the exemplary handcuff assist device 400 (similar to the device 302 shown in FIGS. 2-3), according to some implementations of the current subject matter. As stated above, the handcuff assist device 302 may be a separate device that may be connected by one or more cables to each of the handcuffs (not shown in FIG. 4). Alternatively, the handcuff assist device 302 may be incorporated into one or both handcuffs.

As shown in FIG. 4, the handcuff assist device may be disposed inside the housing 312 (as a separate device or as incorporated into handcuffs' housing). The handcuff assist device 400 may include a coil spring 402, a shaft 406, one or more wheel pulleys 408, 412, a sprocket wheel 416 having a plurality of teeth 418, a locking bar 422 with teeth 420, a locking bar spring 424, and a lock button access 428. The coil spring 402, one or more pulleys 408, 412, and the sprocket wheel 416 may be coupled/positioned on or around the shaft 406. The shaft 406 may be coupled between housing portions 312*a* and 312*b*. In some implementations, the shaft 406 may be permanently coupled to the housing 312 without allowing the shaft 406 to rotate about its own axis. In this implementation, one or more pulleys 408, 412 and the sprocket wheel 416 may be rotatably coupled around the shaft 406 allowing them to rotate about the shaft 406 when coil spring 402 is tensioned and/or released. Further, one end of the coil spring 402, one or more pulleys 408, 412, and the sprocket wheel 416 may be coupled together, whereas another end of the coil spring 402 may be coupled to a portion of the housing 312, at connection 404 (or the shaft 406). This may allow rotation of one or more pulleys 408, 412, and the sprocket wheel 416 about the shaft 406 when the spring 402 is either tensioned or released.

Figure 5B:
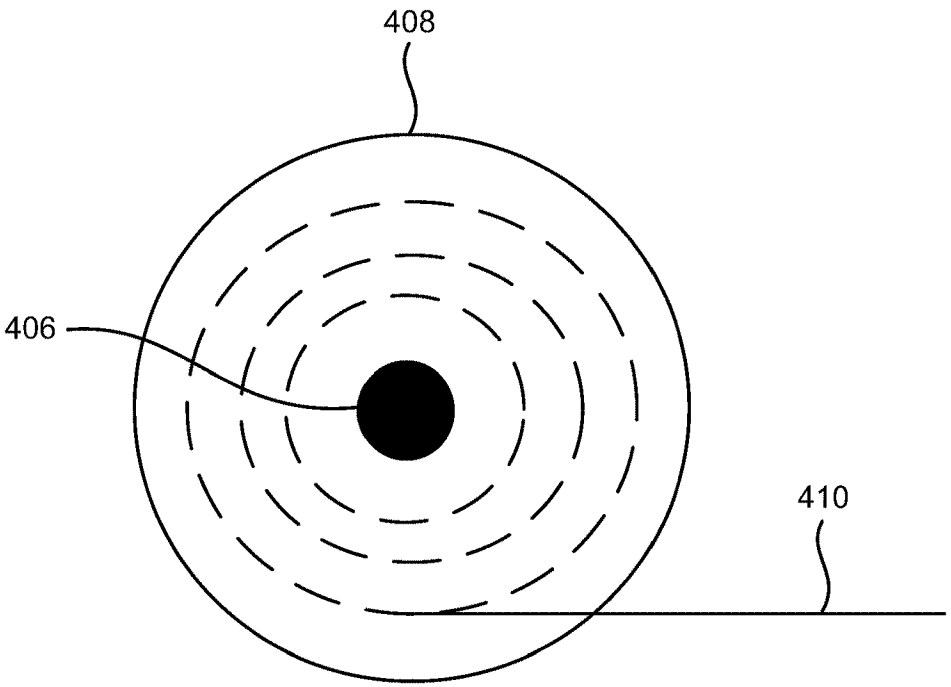
FIG. 5*b* illustrates an exemplary pulley with a cable being wound around the center of the pulley and extending away from the pulley, according to some implementations of the current subject matter.
Figure 5A:
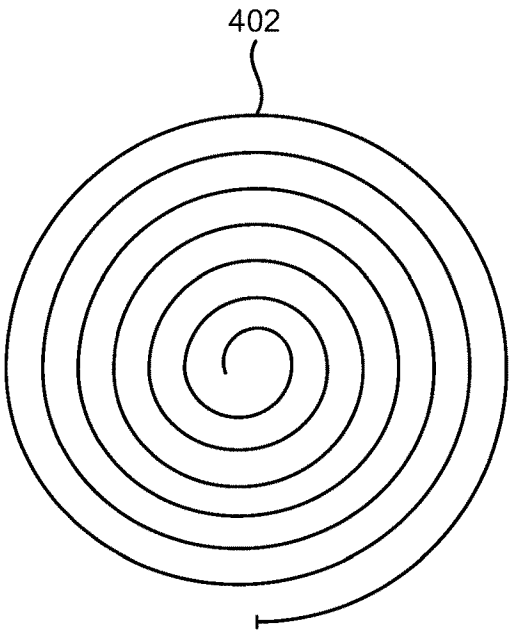
FIG. 5*a* illustrates the exemplary coil spring, according to some implementations of the current subject matter.

Alternatively, the shaft 406 may be configured to be rotatably coupled to the housing 312 and may be configured to rotate about its own axis. In this implementation, one or more pulleys 408, 412 and the sprocket wheel 416 may be permanently coupled to the shaft 406, preventing their separate rotations. Further, one end of the coil spring 402 may be coupled to the shaft 406, whereas the other end of the coil spring 402 may be coupled to the housing 312 (at 404). Upon rotation of the shaft in one direction, the coil spring 402 may be wound, thereby increasing tension in the coil spring 402 and when the shaft 406 is rotated in an opposite direction, the coil spring 402 is unwound, thereby decreasing tension in the coil spring 402. FIG. 5*a* illustrates the exemplary coil spring 402 (without showing it attached to the shaft 406).

The handcuff assist device 400 may include one or more pulley wheels or pulleys 408, 412. The pulleys may be configured to be coupled to one end of a cable. Another end of the cable may be coupled to a handcuff (as shown in FIG. 3). For example, cable 410 may be coupled to the pulley 408. If there is more than one pulley, as for example is shown in FIG. 4, another cable 414 may be coupled to the pulley 412. The cables may be coupled at any location on the pulley (e.g., sides, center, etc.) and using any mechanism, e.g., welding, gluing, soldering, hooks, clips, ball-and-chain, etc. and/or any combination thereof. Alternatively, the cables may be coupled to the shaft 406. FIG. 5*b* illustrates an exemplary pulley 408 with the cable 410 being wound around the center of the pulley 408 and extending away from the pulley.

In some implementations, the pulleys may include a center portion that is disposed proximate to and about the shaft 406 and two circular sidewalls, thereby forming an "H" shape cross-section. This may allow easy winding of cables 410, 414 around the center of the pulleys. Widths of the pulleys may be sufficient to accommodate a desired length of wound cables. During use of the handcuff assist device, the pulley rotates, as a result of a tensioning pressure being applied by the coil spring 402, about shaft 406 winding the cable (e.g., cables 410, 414) about its center, and hence, bringing the handcuffs closer together.

Referring to FIG. 4, the handcuff assist device 400 may further include a sprocket wheel 416 having a plurality of teeth 418. The teeth 418 may have any shape (e.g., a triangular (as shown in FIG. 4), square, circular, oval, irregular, etc.) and may be positioned on the sprocket wheel 416 at any frequency, length, depth, angle, etc. The teeth 418 may extend outwardly away from the sprocket wheel 416. In some implementations, the teeth 418 may be extending in a direction perpendicular to the plane of the sprocket wheel 416. In alternate implementations, the teeth 418 may be extending in the same plane as the plane of the sprocket wheel 416.

Figure 6B:
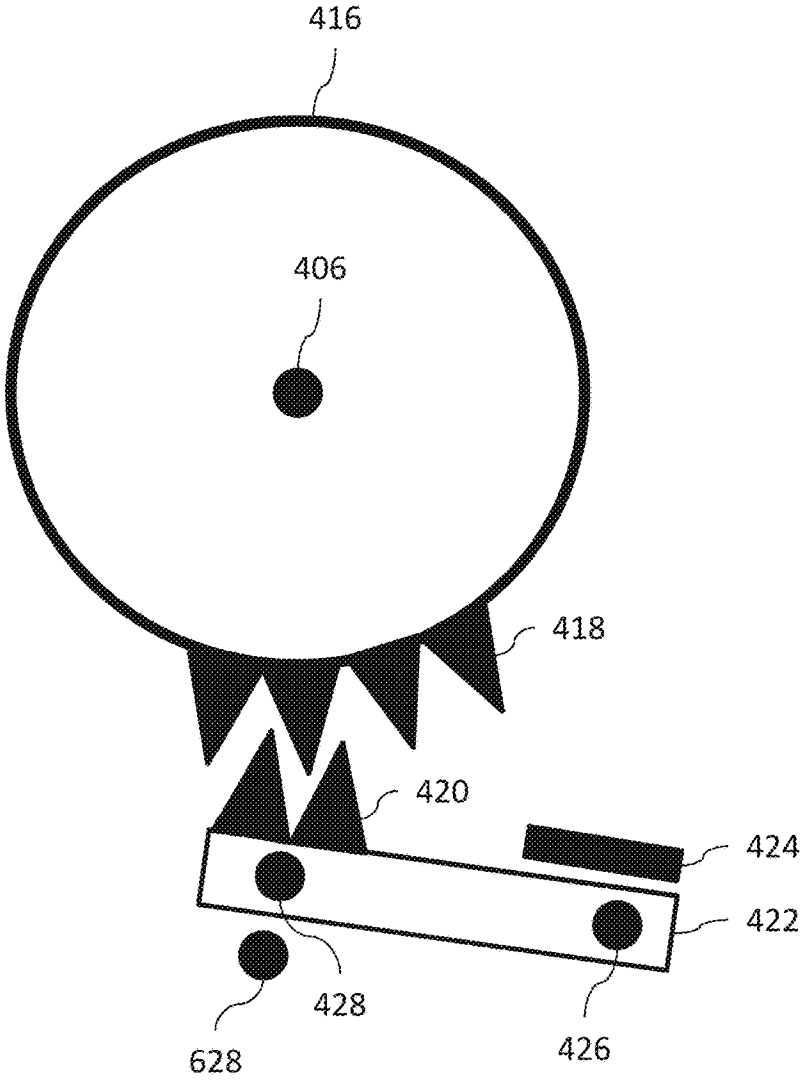
FIG. 6*b* illustrates an exemplary locking bar in an engaged state, according to some implementations of the current subject matter.
Figure 6A:
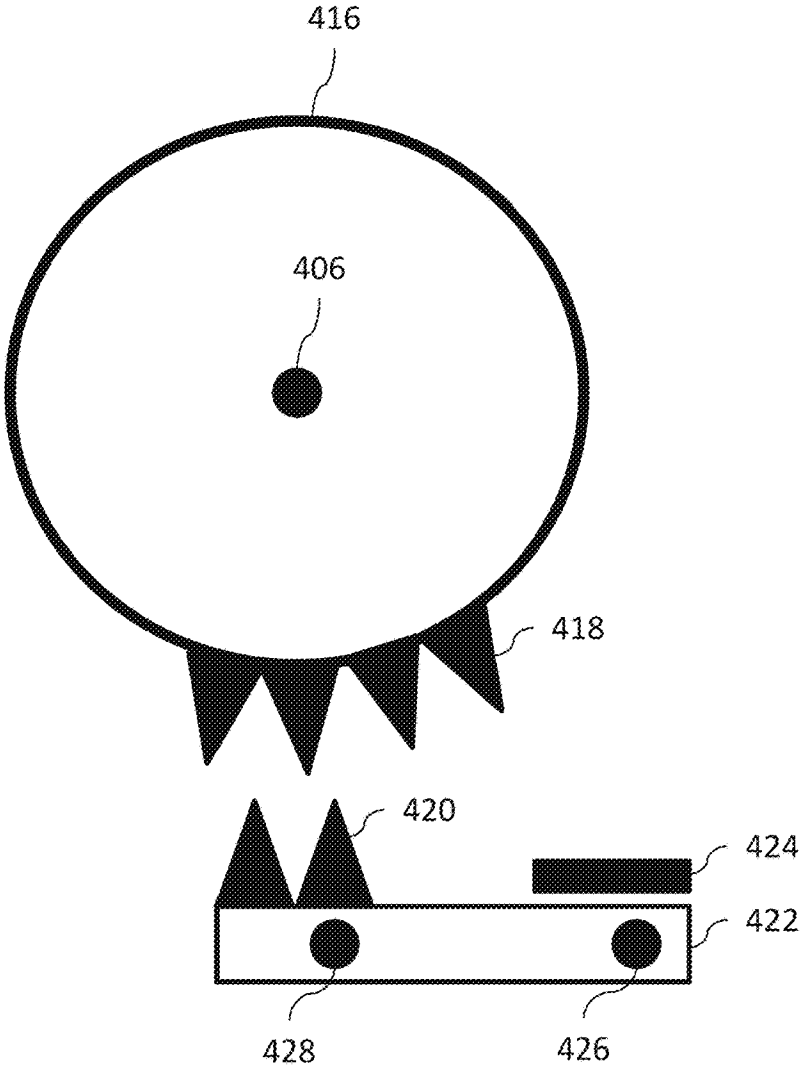
FIG. 6*a* illustrates an exemplary locking bar in a disengaged state, according to some implementations of the current subject matter.

In some implementations, the teeth 418 may be configured to interact with teeth 420 of the locking bar 422, as shown in FIGS. 4, 6*a*-6*b*. When teeth 420 and teeth 418 come in contact with or engage each other during rotation of the sprocket wheel 416, the engaging of the teeth 418, 420 may be configured to prevent further rotation of the sprocket wheel 416, as shown in FIG. 6*b* (and hence, stopping rotation of the pulleys 408, 412 and unwinding of the spring 402). Disengaging of the teeth 418, 420, as shown in FIG. 6*a*, may be configured to allow free rotation of the sprocket wheel 416 (and hence, allowing rotation of the pulleys 408, 412 and winding of the spring 402).

In some implementations, engaging of the teeth 418, 420 may be controlled by the locking bar 422 that may be configured to be hingedly or rotatably coupled to the housing 312. Positioning of the locking bar 422 may depend on the orientation of the teeth 418 of the sprocket wheel 416. The locking bar 422 may be coupled to any location within the housing 312 as along as its teeth 420 are able to engage the teeth 418 of the sprocket wheel 416, as shown in FIG. 6*b*.

FIG. 6*a* illustrates the locking bar 422 in a disengaged state. The bar 422 may be coupled to the housing 312 (not shown in FIG. 6*a*) using a hinge 426. The hinge 426 may allow the locking bar 422 to be elevated (or otherwise, moved) for the purposes of engaging the teeth 418 of the sprocket wheel 416 (only a few teeth 418 are shown in FIGS. 6*a*-*b* for ease of illustration), as shown in FIG. 6*b*. The locking bar 422 may include the locking bar spring 424 that may pull on the locking bar 422 for the purposes of engaging of the teeth 418 and 420. One end of the spring 424 may be coupled to the housing 312 and the end of the spring 424 may be coupled to the locking bar 422. The spring 424 may be engaged/disengaged, when a user presses the lock button 308 (shown in FIG. 3) to lock or release the locking bar 422. The locking button 308 may have locking elements 428 and 628 that may be configured to interact with one another to engage/disengage the button and hence the bar 422. A key lock (accessed through keyhole 310 shown in FIG. 3) may be configured to prevent engagement of the lock button 308.

As shown in FIG. 6*b*, once the locking button is pressed, the locking bar 422 may be configured to change its position (shown as raised in FIG. 6*b*) with respect to the sprocket wheel 416, thereby allowing the teeth 418 and 420 to engage, and as such prevent rotation of the sprocket wheel 416 (and other components shown in FIG. 4). This, in turn, prevents extension of a cable. Pressing of the lock button again may cause the locking bar 422 to again change its position (as shown in FIG. 6*a*) with the respect to the sprocket wheel 416 and allow rotation of the sprocket wheel 416 (and other components shown in FIG. 4).

In some implementations, the spring 424 together with the locking bar 422 may be configured as a ratcheting mechanism that may allow the teeth 420 to permit rotation of the sprocket wheel 416 in one direction but not in another direction. This may allow shortening of the cable(s), but not lengthening of the cable(s), when the locking bar 422 is in an elevated position (as the spring 424 may be configured to retain the locking bar 422 in such elevated position), as shown in FIG. 6*b*.

In view of the arrangement of the locking bar 422 and the sprocket wheel 416, the cable(s) (not shown in FIGS. 6*a-b*) may be easily pulled apart (while the bar 422 and the wheel 416 are in a position shown in FIG. 6*a*) to allow cuffing an individual while the individual's wrists (or ankles) are not necessarily positioned in close proximity to each other. Once the individual is cuffed, the locking button 308 of the handcuff assist device (or the handcuffs themselves) may be engaged, causing the spring 402 to being winding, thereby causing the pulley(s) 408, 412 to rotate and begin winding the cable(s) 410, 414, respectively around them. Engagement of the locking button 308 also releases the bar 422 into position shown in FIG. 6*b*, allowing engagement of the teeth 418 and 420. The arrangement of the bar 422 and the wheel 416 may create a ratcheting mechanism that prevents releasing of the cables and instead allowing tightening of the cables as the individual's wrists are brought closer together. Winding of the cables may continue until the cables are completed wound around the pulleys (or until a stopper that may be disposed on the cables is reached). To release the cables, a key may be inserted into the keyhole 310 and the lock button 308 may be pushed to release the spring 424, which in turn, may push the locking bar 422 into a release position shown in FIG. 6*a*, thereby allowing the device 400 to be ready for next use.

The handcuff device may provide valuable assistance to the law enforcement personnel in subduing an individual that may be resisting arrest. It may also prevent injury to the law enforcement personnel while performing an arrest of violent individuals.

In some implementations, the current subject matter relates to a handcuffs assist device (as for example described above). The device may include a housing including a shaft. The housing may also include one or more pulley wheels positioned about the shaft and coupled to a first end of one or more handcuff cables, wherein a second end of the one or more handcuff cables being coupled to one or more handcuffs. Further, the housing may also include a ratcheting mechanism including a sprocket wheel positioned about the shaft and a locking bar coupled to the housing, the locking bar having a locked configuration and an unlocked configuration. At least one of the shaft, the one or more pulley wheels and the sprocket wheel may be configured to rotate about the shaft in a first direction and not in the second direction when the ratcheting mechanism is in a locked configuration.

In some implementations, the current subject matter may include one or more of the following optional features. In some implementations, rotation of the one or more pulley wheels in the first direction may be configured to wind the one or more handcuff cables about the one or more pulley wheels, thereby positioning the handcuffs proximate to one another. In some implementations, the sprocket wheel may include a plurality of sprocket wheel teeth. The locking bar may include a plurality locking bar teeth. The sprocket wheel teeth and the locking bar teeth may be configured to engage each other when the ratcheting mechanism is in the locked configuration, thereby preventing rotation of the sprocket wheel in a second direction. The second direction may be opposite the first direction.

In some implementations, the device may include a locking mechanism configured to engage and disengage the locked configuration of the ratcheting mechanism.

In some implementations, the device may include a coil spring positioned about the shaft, wherein the coil spring is configured to increase speed of rotation of at least one of the shaft, the one or more pulley wheels and the sprocket wheel about the shaft in the first direction, thereby tensioning the one or more cables. A first end of the coil spring may be coupled to the shaft and a second end of the coil spring may be coupled to the housing. The shaft may be rotatably coupled to at least one portion all of the housing. At least one of the one or more pulley wheels, the sprocket wheel, and at least one end of the coil spring may be permanently coupled to the shaft.

In some implementations, the shaft may be permanently coupled to at least one portion all of the housing. At least one of the one or more pulley wheels, the sprocket wheel, and at least one end of the coil spring may be rotatably coupled to the shaft.

In some implementations, the locking bar may be coupled at another portion of the housing.

In some implementations, the housing may be a housing of the one or more handcuffs.

In some implementations, the handcuff assist device may be separate from the one or more handcuffs and may be configured to be coupled to each of the one or more handcuffs using the one or more cables.

In some implementations, the current subject matter relates to a handcuff. The handcuff may include a housing that, in turn may include a wrist cuffing portion, and a handcuff assist device. The handcuff assist device may include a shaft, one or more pulley wheels positioned about the shaft and coupled to a first end of one or more handcuff cables, wherein a second end of the one or more handcuff cables being coupled to another handcuff, a ratcheting mechanism including a sprocket wheel positioned about the shaft and a locking bar coupled to the housing, the locking bar having a locked configuration and an unlocked configuration. At least one of the shaft, the one or more pulley wheels and the sprocket wheel may be configured to rotate about the shaft in a first direction and not in the second direction when the ratcheting mechanism is in a locked configuration.

In some implementations, the current subject matter may include one or more of the following optional features. In some implementations, rotation of the one or more pulley wheels in the first direction may be configured to wind the one or more handcuff cables about the one or more pulley wheels, thereby positioning the another handcuff proximate to the handcuff.

In some implementations, the sprocket wheel mat include a plurality of sprocket wheel teeth. The locking bar may include a plurality locking bar teeth. The sprocket wheel teeth and the locking bar teeth may be configured to engage each other when the ratcheting mechanism is in the locked configuration, thereby preventing rotation of the sprocket wheel in a second direction. The second direction may be opposite the first direction.

In some implementations, the handcuff may include a locking mechanism configured to engage and disengage the locked configuration of the ratcheting mechanism.

In some implementations, the handcuff may include a coil spring positioned about the shaft, wherein the coil spring is configured to increase speed of rotation of at least one of the shaft, the one or more pulley wheels and the sprocket wheel about the shaft in the first direction, thereby tensioning the one or more cables. A first end of the coil spring may be coupled to the shaft and a second end of the coil spring may be coupled to the housing.

In some implementations, the shaft may be rotatably coupled to at least one portion all of the housing, and at least one of the one or more pulley wheels, the sprocket wheel, and at least one end of the coil spring may be permanently coupled to the shaft.

In some implementations, the shaft may be permanently coupled to at least one portion all of the housing, and at least one of the one or more pulley wheels, the sprocket wheel, and at least one end of the coil spring may be rotatably coupled to the shaft.

In some implementations, the locking bar may be coupled at another portion of the housing.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." In addition, use of the term "based on," above and in the claims is intended to mean, "based at least in part on," such that an unrecited feature or element is also permissible.

Example embodiments of the methods and components of the present invention have been described herein. As noted elsewhere, these example embodiments have been described for illustrative purposes only, and are not limiting. Other embodiments are possible and are covered by the invention. Such embodiments will be apparent to persons skilled in the relevant art(s) based on the teachings contained herein. Thus, the breadth and scope of the present invention should not be limited by any of the above-described exemplary embodiments, but should be defined only in accordance with the following claims and their equivalents.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few implementations have been described in detail above, other modifications or additions are possible. In particular, further features and/or implementations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. Other implementations may be within the scope of the following claims.

What is claimed:

1. A handcuffs assist device, comprising:

a housing including a shaft coupled to the housing;

one or more pulley wheels positioned about the shaft and coupled to a first end of each handcuff cable in a pair of handcuff cables, wherein a second end of each handcuff cable being coupled to a handcuff in the pair of handcuffs, each handcuff in the pair of handcuffs being separate and configured to be positioned away from the housing and connected to the housing using its respective handcuff cable in the pair of handcuff cables;

a ratcheting mechanism including a sprocket wheel positioned about the shaft and a locking bar coupled to the housing, the locking bar having a locked configuration and an unlocked configuration, the locking bar being rotatably coupled to the housing using a locking bar hinge and including a locking bar spring, the locking bar spring, upon being externally activated, using a mechanical button disposed on the housing, is configured to rotate the locking bar in a first locking bar direction about the locking bar hinge to engage the ratcheting mechanism in the locked configuration and rotate the locking bar in a second locking bar direction about the locking bar hinge to disengage the ratcheting mechanism in the unlocked configuration, the mechanical button, upon activation, is configured to selectably prevent extension of both handcuff cables from the housing and to cause to selectably retract both handcuff cables into the housing;

the one or more pulley wheels and the sprocket wheel are configured to rotate about the shaft in a first direction and not in the second direction when the ratcheting mechanism is in a locked configuration.

2. The device according to claim 1, wherein rotation of the one or more pulley wheels in the first direction is configured to wind the one or more handcuff cables about the one or more pulley wheels, thereby positioning the handcuffs proximate to one another.

3. The device according to claim 2, wherein the sprocket wheel includes a plurality of sprocket wheel teeth;

the locking bar includes a plurality locking bar teeth;

the sprocket wheel teeth and the locking bar teeth are configured to engage each other when the ratcheting mechanism is in the locked configuration, thereby preventing rotation of the sprocket wheel in a second direction.

4. The device according to claim 3, wherein the second direction being opposite the first direction.

5. The device according to claim 1, further comprising a locking mechanism configured to engage and disengage the locked configuration of the ratcheting mechanism.

6. The device according to claim 1, further comprising a coil spring positioned about the shaft, wherein the coil spring is configured to increase speed of rotation of at least one of the shaft, the one or more pulley wheels and the sprocket wheel about the shaft in the first direction, thereby tensioning the one or more cables.

7. The device according to claim 6, wherein a first end of the coil spring is coupled to the shaft and a second end of the coil spring is coupled to the housing.

8. The device according to claim 6, wherein the shaft is rotatably coupled to at least one portion all of the housing, and at least one of the one or more pulley wheels, the sprocket wheel, and at least one end of the coil spring are permanently coupled to the shaft.

9. The device according to claim 6, wherein the shaft is permanently coupled to at least one portion all of the housing, and at least one of the one or more pulley wheels, the sprocket wheel, and at least one end of the coil spring are rotatably coupled to the shaft.

10. The device according to claim 6, wherein the locking bar is coupled at another portion of the housing.

11. A handcuff, comprising:

a housing including a wrist cuffing portion;

a handcuff assist device including a shaft coupled to the housing;

one or more pulley wheels positioned about the shaft and coupled to a first end of each handcuff cable in a pair of handcuff cables, wherein a second end of each handcuff cable being coupled to a handcuff in the pair of handcuffs, each handcuff in the pair of handcuffs being separate and configured to be positioned away from the housing and connected to the housing using its respective handcuff cable in the pair of handcuff cables;

a ratcheting mechanism including a sprocket wheel positioned about the shaft and a locking bar coupled to the housing, the locking bar having a locked configuration and an unlocked configuration, the locking bar being rotatably coupled to the housing using a locking bar hinge and including a locking bar spring, the locking bar spring, upon being externally activated, using a mechanical button disposed on the housing, is configured to rotate the locking bar in a first locking bar direction about the locking bar hinge to engage the ratcheting mechanism in the locked configuration and rotate the locking bar in a second locking bar direction about the locking bar hinge to disengage the ratcheting mechanism in the unlocked configuration, the mechanical button, upon activation, is configured to selectably prevent extension of both handcuff cables from the housing and to cause to selectably retract both handcuff cables into the housing;

the one or more pulley wheels and the sprocket wheel are configured to rotate about the shaft in a first direction and not in the second direction when the ratcheting mechanism is in a locked configuration.

12. The handcuff according to claim 11, wherein rotation of the one or more pulley wheels in the first direction is configured to wind the one or more handcuff cables about the one or more pulley wheels, thereby positioning the another handcuff proximate to the handcuff.

13. The handcuff according to claim 12, wherein the sprocket wheel includes a plurality of sprocket wheel teeth;

the locking bar includes a plurality locking bar teeth;

the sprocket wheel teeth and the locking bar teeth are configured to engage each other when the ratcheting mechanism is in the locked configuration, thereby preventing rotation of the sprocket wheel in a second direction.

14. The handcuff according to claim 13, wherein the second direction being opposite the first direction.

15. The handcuff according to claim 11, further comprising a locking mechanism configured to engage and disengage the locked configuration of the ratcheting mechanism.

16. The handcuff according to claim 11, further comprising a coil spring positioned about the shaft, wherein the coil spring is configured to increase speed of rotation of at least one of the shaft, the one or more pulley wheels and the sprocket wheel about the shaft in the first direction, thereby tensioning the one or more cables.

17. The handcuff according to claim 16, wherein a first end of the coil spring is coupled to the shaft and a second end of the coil spring is coupled to the housing.

18. The handcuff according to claim 16, wherein the shaft is rotatably coupled to at least one portion all of the housing, and at least one of the one or more pulley wheels, the sprocket wheel, and at least one end of the coil spring are permanently coupled to the shaft.

19. The handcuff according to claim 16, wherein the shaft is permanently coupled to at least one portion all of the housing, and at least one of the one or more pulley wheels, the sprocket wheel, and at least one end of the coil spring are rotatably coupled to the shaft.

20. The handcuff according to claim 16, wherein the locking bar is coupled at another portion of the housing.

* * * * *